United States Patent [19]

Giorgi

[11] Patent Number: 4,699,602

[45] Date of Patent: Oct. 13, 1987

[54] PLAY SET FOR GAME OF SKILL WITH PIECES FORMED BY CUBES

[76] Inventor: Giorgio Giorgi, Via G. Menconi, 8 Bis, Avenza, Massa Carrara, Italy

[21] Appl. No.: 808,897

[22] Filed: Dec. 13, 1985

[30] Foreign Application Priority Data

Dec. 17, 1984 [IT] Italy ..... 18315 A/84

[51] Int. Cl.[4] ..... A63H 33/08

[52] U.S. Cl. ..... 446/124; 446/85; 446/490; 273/157 R; 434/211

[58] Field of Search ..... 446/490, 124, 85, 92, 446/487, 380, 125; 434/211, 215; 273/157 R

[56] References Cited

U.S. PATENT DOCUMENTS

| | | | |
|---|---|---|---|
| 957,666 | 5/1910 | Ferguson | 446/380 |
| 3,184,882 | 5/1965 | Vega | 446/92 |
| 3,236,004 | 2/1966 | Christiansen | 446/102 |
| 3,546,792 | 12/1970 | Sherman | 446/124 X |
| 3,577,673 | 5/1971 | Monestier | 446/490 |
| 4,484,406 | 11/1984 | Matsumoto et al. | 446/487 |

OTHER PUBLICATIONS

Enigmi E. Ciochi Matematici, Volume Primo, Martin Gardner, Sansoni ©1983.

*Primary Examiner*—Mickey Yu

*Attorney, Agent, or Firm*—McGlew and Tuttle

[57] ABSTRACT

The play set having a plurality of pieces having fixed shape, each of which is ideally made up of a number of variously disposed cubes, with at least a face in common, and at least a piece of variable shape and actually made up of a number of cubes variously matchable between them for taking up a number of shapes, always with a face in common; said pieces of fixed and variable shape being combinable between them to generate various spatial patterns.

1 Claim, 11 Drawing Figures

Fig.4
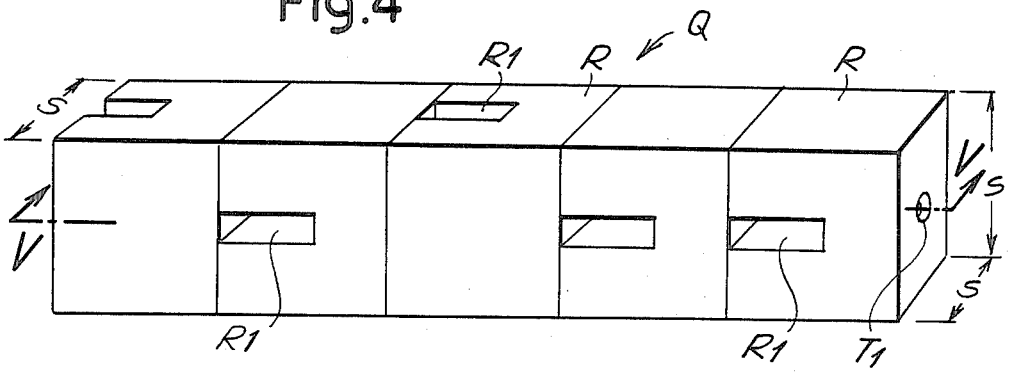
Fig.5
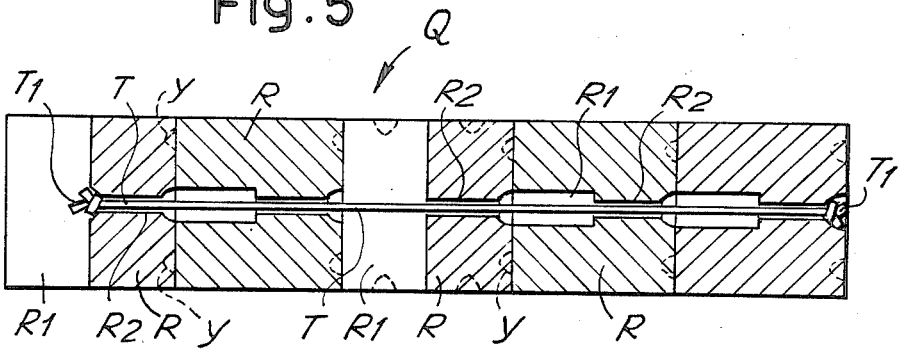
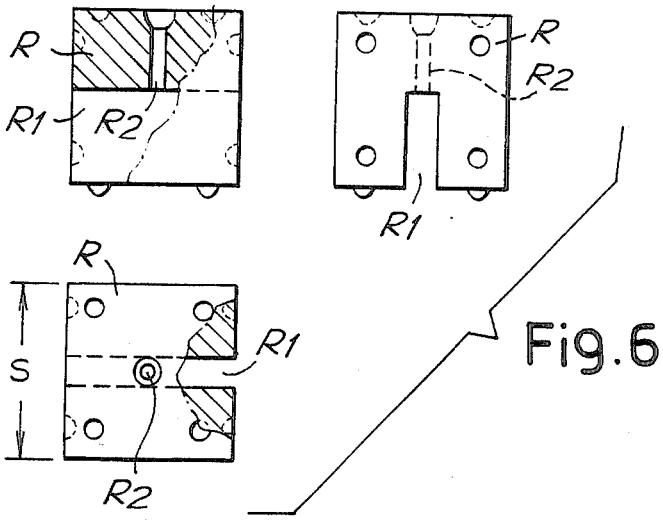
Fig.6

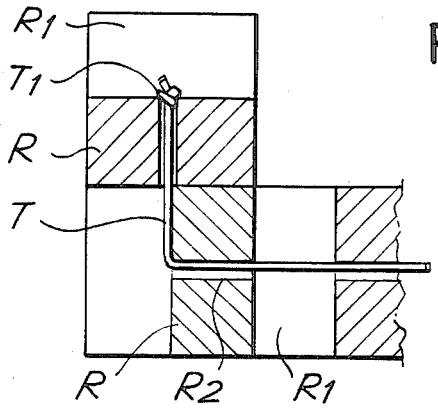
Fig.7
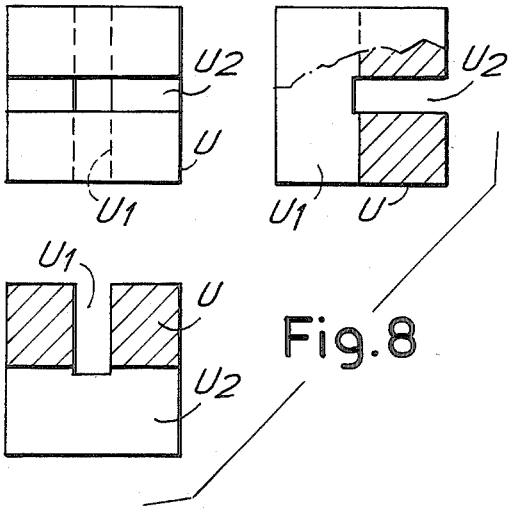
Fig.8
Fig.9
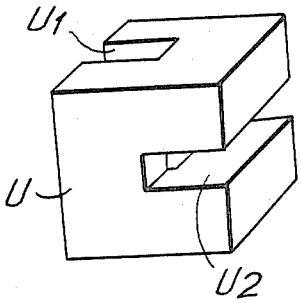
Fig.10
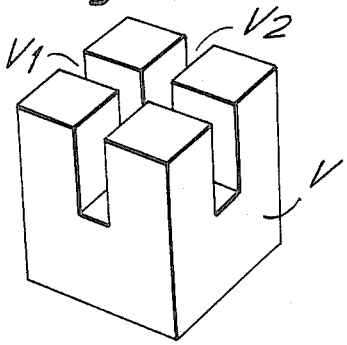
Fig.11
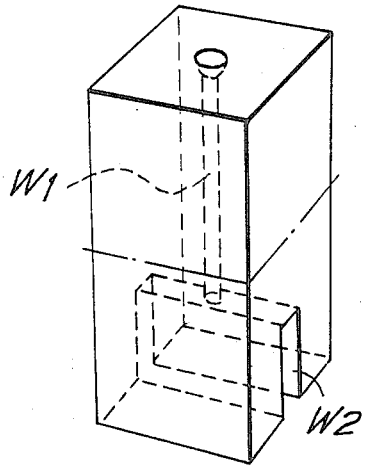

PLAY SET FOR GAME OF SKILL WITH PIECES FORMED BY CUBES

FIELD AND BACKGROUND OF THE INVENTION

The invention provides a play set for games of patience, skill and reasoning.

SUMMARY OF THE INVENTION

Substantially, the inventive play set comprises a plurality of pieces having fixed shape, each of which being ideally made up of a number of variously disposed cubes with at least a face in common, and at least a piece of variable shape actually made up of a number of cubes variably matchable between them for taking up a number of shapes, always with a face in common. These pieces of fixed and variable shape can be combined between them to generate various spatial patterns.

All pieces having fixed shape have a flat form with a thickness equal to that of the cube side.

In one embodiment of the invention, the pieces having fixed shape are twelve, eleven of which being ideally made up of five cubes and one of which being ideally made up of four cubes.

The play set may comprise at least a piece of variable shape made up of five cubes variably matchable between them.

The cubes of a piece having variable shape may be connected between them by an elastic band which goes through them through a passage formed at least by a cut along which the elastic band can be moved. The elastic band may pass a through hole formed between the bottom of a cut and the wall opposite thereto. In another embodiment, one of the cubes may have two crossed cuts arising from the same face. In a further embodiment, one of the cubes may have two cuts arising from two opposite faces and lying in orthogonal planes.

The cubes making up the piece of variable shape may be magnetized for connection or may be connected by restraining joints.

BRIEF DESCRIPTION OF THE DRAWINGS

In the Drawings

FIG. 4 is an enlarged perspective view similar to FIG. 1 showing details of construction for the variable configuration pieces;

FIG. 5 is a cross-sectional view taken along line V—V of FIG. 4;

FIG. 6 is a partially sectional view showing different views of a cube used in the variable configuration piece of FIGS. 4 and 5;

FIG. 7 is a partial sectional view showing how a variable configuration can be achieved using the piece of FIG. 4;

FIG. 8 is a view similar to FIG. 6 showing views of the cube of FIG. 9;

FIG. 9 is a perspective view of an alternate form of a cube which can be used to form the variable configuration piece.

FIG. 10 is a view similar to FIG. 9 of a still further form of the cube; and

FIG. 11 is a perspective viewing showing two cubes connected together to form a two cube piece.

DESCRIPTION OF THE PREFERRED EMBODIMENT

Figures 1, 2, 3:
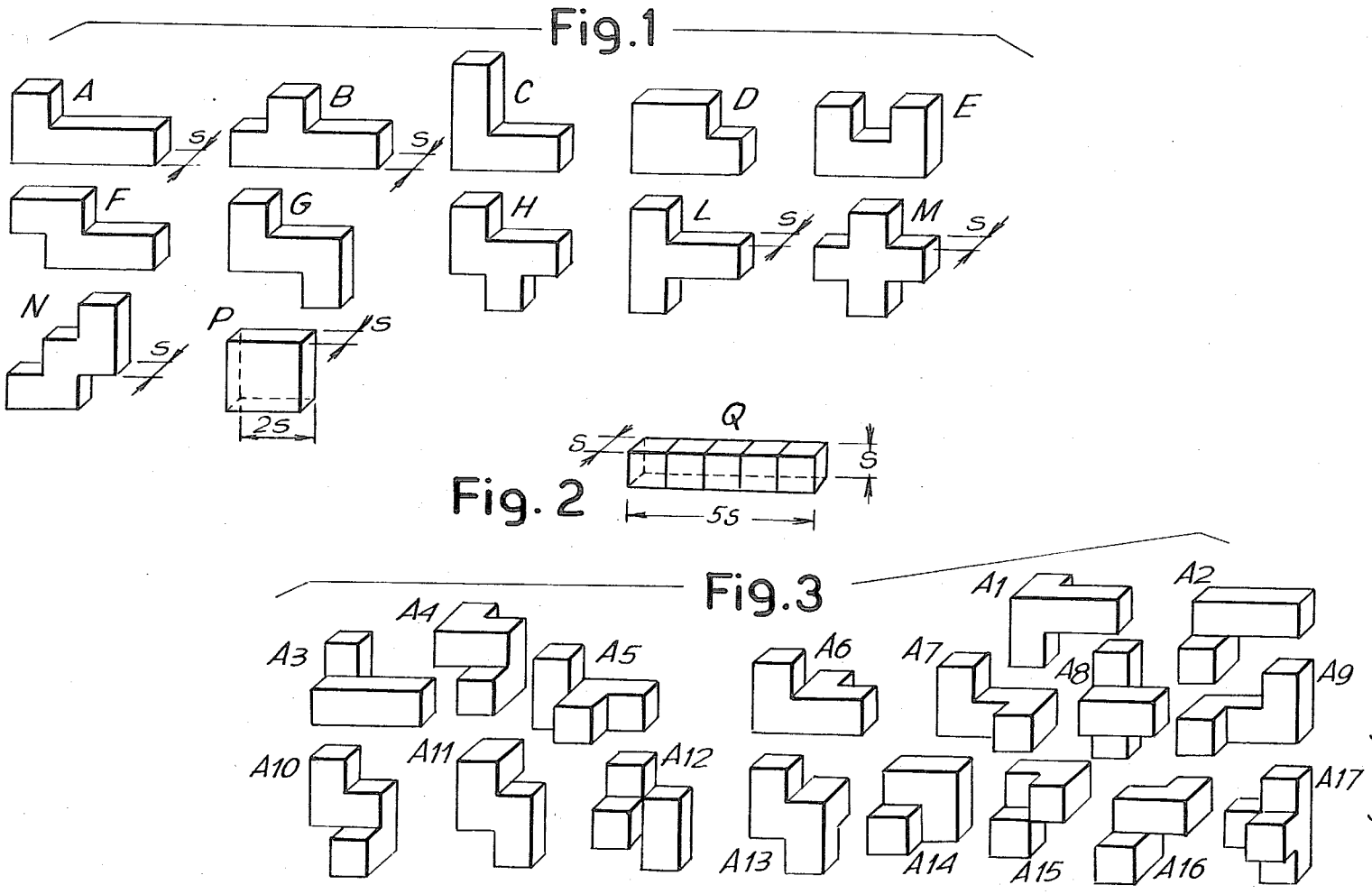
FIG. 1 is a perspective view of 12 fixed configuration pieces of the invention.
FIG. 2 is a perspective view of one variable configuration piece of the invention.
FIG. 3 is a perspective view showing 17 three-dimensional fixed configuration pieces which are different from those shown in FIG. 1.

According to the illustrated embodiment, the play set comprises thirteen pieces, twelve of which are of fixed configuration or shape, as shown in FIG. 1, and are indicated with A,B,C,D,E,F,G,H,L,M,N,P. Each piece is geometrically formed by the junction of a number of like cubes having unitary thickness s and at least a face in common. The pieces A,B,C,D,E,F,G,H,L,M,N are ideally obtained by the junction of five cubes, while the piece P is obtained by the junction of four cubes only, in order to form a square base parallelepiped with a height equal to s. A thirteenth piece Q is really made up of five cubes and its shape may vary from its primary shape Q shown in FIG. 2 to at least one of the other twenty-eight combinations that can be obtained by joining five cubes by putting in common one or more faces. In FIG. 3, seventeen possible three-dimensional combinations are shown designated by A1,A2,A3,A4,A5,A6,A7,A8-,A9,A10,A11, A12,A13,A14,A15,A16,A17. The forms or conformations A,B,C,D,E,F,G,H,L,M,N, shown in FIG. 2, can be added to those of FIG. 3.

A mechanism for assembling the piece Q is illustrated in FIGS. 4 and 5. The piece Q is made up of five cubes R, and each cube—as seen in FIG. 6—has a central slot-shaped cut R1 and a central hole R2 with an elastic band T passing through them and having the ends T1 secured to the first and to the last of cubes R. Slot R1 and hole R2 are parallel to side faces of cube R. The elastic band T permits both the approach and the stability of a mutual positioning of the cubes, and a possible transformation of the piece by a temporary stretching in order to slide a cube upon the other while the elastic band T can be arranged along the bottom of a cut R1. A possible different arrangement is shown in FIG. 7. The possible combinations obtainable with such a piece are eighteen. This mechanism, although making integral part of the invention, can be replaced with others without altering the play set or game effectiveness.

FIGS. 8 and 9 show a cube U with two cuts U1 and U2 orthogonal and opposite to each other. FIG. 10 shows a cube V with two cuts V1 and V2 orthogonal between them and arising from the same face, and the hole in correspondence of the cuts intersection. FIG. 11 shows a component W ideally made up of two cubes, with an axial hole W1 and a cut W2. By these pieces, similar combinations can be obtained.

By means of the above described materials, there is the possibility to construct in a plurality of manners—by utilizing all the thirteen pieces—a cube having the side equal to 4*s* or a square base parallelepiped having dimensions: 8*s*, 8*s*, 1*s*, in addition to a number of other bodies.

The individual pieces can be made of any material: wood, plastics and metal are, however, the material most suitable to the construction of the pieces.

Four possible projections Y on one face and corresponding recesses on other faces of the cubes can assure the centering and stability in the various positions.

The drawing shows only one exemplification of the invention which may vary in the forms and dispositions. The following modified embodiments, with others, may be provided, in which the invention can be realized:

play sets which comprise, in addition to the piece Q, one or more mobile pieces as a partial or whole replacement of the remaining pieces; play sets which comprise the replacement of one or more pieces with others deriving from the junction or disassembly of the replaced pieces; play sets which comprise, in place of one or more pieces, other pieces geometrically formed by the same number of cubes, as for example by replacing the piece M with the piece D, and thus having in this case two like pieces in the play set, or by replacing the piece P with one formed by four cubes being lined up as in FIG. 4; play sets in which the piece Q is constructed with different mechanisms anyway allowing the mobile junction of one cube with the other, and with other features; play sets comprising any combination of the above described embodiments.

FIG. 1 shows pieces A through N which are formed of 5 cubes lying in different fixed configurations. Piece P has four cubes lying in a plane. Piece A is L-shaped with 4 cubes in a line and the fifth connected to the side of the last cube in line. Piece B is made of four cubes in line with the fifth cube extending from the side of one of the intermediate cubes. Piece C is a V-shaped piece. B is a piece having four cubes forming a square and the fifth cube connected to the side of one of the cubes in the square. Piece E is a U-shaped piece. Piece F is a Z-shaped piece having three cubes connected in line and two additional cubes connected in line and connected to an end 1 of the three cubes. Piece G is an S-shaped piece. Piece H is a piece having three cubes extending in a line, a fourth cube connected to the side of the middle cube in line and a fifth cube connected to the end cube in line and on an opposite side thereof from the fourth cube. Piece L is a T-shaped piece. Piece M is a cross-shaped piece with each leg of the cross formed by a single cube. Piece N is a W-shaped piece. Piece P is a square piece made up of four cubes.

I claim:

1. A play set consisting of: eleven fixed configuration pieces (A–N) each made up of five rigidly connected identical cubes lying in a common plane with common top and bottom surfaces, said eleven fixed configuration pieces comprising, one piece (A) having four cubes in a row and a fifth cube connected to a side of an end cube in the row and said fifth cube being out of alignment with respect to said row, one piece (B) having four cubes in a row and a fifth cube connected to a side of an intermediate cube in the row, one V-shaped piece (C), one piece (D) having four cubes connected to form a square and a fifth cube connected to a side of one of said cubes that form a square, one U-shaped piece (E), one S-shaped piece (F), one piece (G) having three cubes in a row with a fourth cube connected to a side of an end cube in the row and a fifth cube connected to an opposite side of an opposite end cube in the row which is opposite from said fourth cube and said fourth and fifth cubes being out of alignment with respect to said row, one piece (H) having three cubes in a row with a fourth cube connected to a side of an intermediate cube in the row and a fifth cube connected to an opposite side of an end cube in the row which is opposite from said fourth cube, one T-shaped piece, (L), one cross-shaped piece (M), and one W-shaped piece (N);

one fixed configuration piece having four identical fixedly connected together cubes lying in a common plane with common top and bottom surfaces and forming a square; and one variable configuration piece comprising five identical cubes and connecting means connecting said five identical cubes together for permitting varied configurations for said variable configuration piece, each of said five identical cubes of said variable configuration piece always having common top and bottom surfaces and lying in a common plane, all cubes of each variable configuration piece comprising a cube having a central slot in one end thereof extending from said bottom to said top surface and a central hole extending through an opposite end thereof and into communication with said slot, said means for connecting said cubes of said variable configuration piece comprising an elastic band extending through each hole of each cube and through each slot of each cube;

said cubes of said fixed and variable configuration pieces all having identical outside dimensions so that said fixed and variable configuration pieces can be mated together to form a variety of combined configurations.

* * * * *